US008676105B2

(12) United States Patent
Kageyama

(10) Patent No.: US 8,676,105 B2
(45) Date of Patent: Mar. 18, 2014

(54) FIXING DEVICE AND IMAGE FORMING APPARATUS USING THE SAME

(75) Inventor: Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 293 days.

(21) Appl. No.: 13/291,446

(22) Filed: Nov. 8, 2011

(65) Prior Publication Data

US 2012/0134724 A1 May 31, 2012

(30) Foreign Application Priority Data

Nov. 30, 2010 (JP) ..... 2010-266623

(51) Int. Cl.
*G03G 15/20* (2006.01)

(52) U.S. Cl.
USPC ..... 399/331

(58) Field of Classification Search
USPC ..... 399/45, 331, 333
See application file for complete search history.

(56) References Cited

U.S. PATENT DOCUMENTS

| | | | | |
|---|---|---|---|---|
| 5,696,596 | A | 12/1997 | Taniguchi | |
| 2010/0247757 | A1 | 9/2010 | Inoue | |
| 2012/0008153 | A1 * | 1/2012 | Kunii et al. | 358/1.9 |
| 2012/0107016 | A1 * | 5/2012 | Yamaji | 399/130 |

FOREIGN PATENT DOCUMENTS

| | | |
|---|---|---|
| JP | 08-022091 | 1/1996 |
| JP | 2008-026477 | 2/2008 |
| JP | 2008-064938 | 3/2008 |
| JP | 2010-224200 | 10/2010 |

* cited by examiner

*Primary Examiner* — Walter L Lindsay, Jr.
*Assistant Examiner* — Rodney Bonnette
(74) *Attorney, Agent, or Firm* — Nixon & Vanderhye, P.C.

(57) ABSTRACT

In an image forming apparatus for forming a lenticular lens structure when using a light-transmissive recording medium, including: photoreceptor drums; chargers; an exposure unit; developing devices; an intermediate transfer belt unit; and a fixing unit, further includes a resin layer forming device for forming a transparent resin layer on a pressing roller and a controller, and a multiple number of grooves are formed in parallel to each other on the surface of the pressing roller so as to create a lenticular lens structure on the pressing member and, the recording medium is pressed between the fixing roller and the pressing roller so as to form a lenticular lens structure on one surface of the recording medium while an unfixed toner image is fixed to the other surface of the recording medium.

8 Claims, 6 Drawing Sheets

FIXING DEVICE AND IMAGE FORMING APPARATUS USING THE SAME

This Nonprovisional application claims priority under 35 U.S.C. §119(a) on Patent Application No. 2010-266623 filed in Japan on 30 Nov. 2010, the entire contents of which are hereby incorporated by reference.

BACKGROUND OF THE INVENTION (1) Field of the Invention

The present invention relates to a fixing device and an image forming apparatus using the device, in particular relating to a fixing device for use in an image forming apparatus for forming images using toner based on electrophotography, such as an electrostatic copier, laser printer, facsimile machine or the like, as well as relating to an image forming apparatus using this device.

(2) Description of the Prior Art

Conventionally, image forming apparatuses based on electrophotography can form high quality images at a reasonable price with high reproducibility and excellent operativity so that they are used for copiers, printers, facsimile machines and multifunctional machines having two or more functions of these and others.

Recording media for use in these image forming apparatuses based on electrophotography may include paper, plastic film and sheet, etc. As one example of recording media, there is a lenticular lens sheet that is formed with lens-like meniscuses on a light transmissive base surface.

A lenticular lens is one that is used in a system called "lenticular system" in which a stereoscopic vision is made possible without using any special device. Use of this lenticular sheet makes it possible to provide a 3D image representation or change the image between multiple different images depending on the angle from which the image is viewed. An image combined with the lens is usually produced in the field of high-volume printing by laminating a light transmissive sheet formed with the lens on a printed image on paper or film.

There has been a disclosed electrophotographic technique in which a toner image is formed using a conventional lens sheet (a sheet with a jagged lenticular surface (see Japanese Patent Application Laid-open H08-22091).

However, the above prior art technology entails the problem that the jagged configuration of the lens sheet causes abnormal electric discharge and also produces stripe-like unevenness in the formed image due to steps of jaggedness.

In order to solve the above problem, there is a disclosure of a configuration in which a recording medium of a light transmissive, transparent substrate having one side formed with a thermoplastic resin layer for forming a lens layer and the other side formed with a thermoplastic image receiving layer, is formed with a toner image first, then formed on the lens-forming layer with a lens so as to produce a lenticular image (see Japanese Patent Application Laid-open 2008-26477).

However, in the above second patent document, the recording medium made of the lens forming layer, substrate and image receiving layer is formed on its receiving layer with a toner image, then the lens forming layer is heat pressed using a forming die so as to form a lenticular image having a lens layer. That is, since the recording medium having passed through the fixing process in which no heat deformation will take place is then subjected to a high-temperature pressing process to form a jagged lens surface, there is a high risk of the toner image being disordered, possibly causing degradation of the lenticular image. Further, the apparatus also entails the problems that not only the power consumption of the apparatus increases but also the apparatus itself becomes bulky.

There is also an idea that a lens layer may be formed using a transparent toner. However, in this case a separate developing vessel for the transparent toner is needed, resulting in a further enlargement of the apparatus. Moreover, the transparent toner is not only needed to have high light transmittance but also is required to have excellent heat processibility. However it is quite difficult for a powdery transparent toner to achieve both high heat processibility and preservation stability.

SUMMARY OF THE INVENTION

The present invention has been devised in view of the above conventional problem, it is therefore an object of the present invention to provide a space-saving fixing device that will not make equipment bulky and can form a lenticular lens structure on a recording medium without causing any degradation of toner image quality as well as providing an image forming apparatus using the device.

In order to solve the above problems, the fixing device according to the present invention as well as the image forming apparatus using this is configured as follows.

The aspect of the present invention resides in a fixing device for forming a lenticular lens structure when using a light-transmissive recording medium, including a fixing member for fusing an unfixed toner image on the recording medium and fixing the unfixed toner image onto the recording medium, a pressing member for conveying the recording medium while pressing the recording medium against the fixing member, a resin layer forming portion (e.g., an ejection nozzle) disposed in close proximity to the pressing member for forming a transparent resin layer by ejecting and applying a light-transmissive resin material on the surface of the pressing member; and a controller for controlling the operation of the resin layer forming portion, wherein the fixing member and the pressing member being put in pressure contact with each other to form a fixing nip portion so that while the recording medium is conveyed through the fixing nip portion by rotation of the fixing member and the pressing member, the unfixed toner image is fixed to the recording medium, wherein a plurality of grooves each having a concavely curved section and extending in the circumferential direction or in the rotational axial direction are formed in parallel to each other on the surface of the pressing member so as to create a lenticular lens structure on the pressing member side of a transparent resin layer formed by the resin layer forming portion, and, wherein, pressing the recording medium on one side of which an unfixed toner image is formed at the fixing nip portion between the fixing member and the pressing member, while transferring the transparent resin layer from the pressing member to the other side of the recording medium, the unfixed toner image is fixed on the one side of the recording medium while a lenticular lens is formed on the other side of the recording medium.

In the present invention, it is preferable that the pressing member is formed of a roller member having a metal core portion and a release layer disposed around the metal core portion, or an endless belt member, and the fixing member is formed of a roller member or an endless belt member.

In the present invention, it is preferable that a resin material that is solid at normal temperature is used as the light-transmissive, and the resin layer forming portion forms the transparent resin layer by a hot melt inkjet system including the steps of heating and fusing the light-transmissive resin material and ejecting the molten light-transmissive resin material toward the surface of the pressing member to form a light-transmissive resin layer on the surface of the pressing member.

In the present invention, it is preferable that the fixing device further includes a layer thickness regulating member disposed at a position in close proximity to the outer periphery of the pressing member, upstream of the fixing nip portion and downstream of the resin layer forming portion with respect to the recording medium conveying direction, for regulating the thickness of the light-transmissive resin layer, and the controller includes a function of controlling the amount of ejection of the light-transmissive resin material from the resin layer forming portion in accordance with the thickness of the recording medium, a function of controlling the gap between the pressing roller and the layer thickness regulating member in accordance with the thickness of the recording medium and a function of controlling the temperature at the fixing nip portion in accordance with the thickness of the recording medium.

In the present invention, it is preferable that the light-transmissive resin material ejected from the hot melt inkjet system is comprised of a light-transmissive resin and a wax having a phase change temperature of 60 deg.C. or higher.

In the present invention, it is preferable that the pressing member has a heat source therein and fuses the light-transmissive resin material ejected and applied on the surface thereof.

In the present invention, it is preferable that the fixing device further includes a contact/retract unit for bringing the pressing member into and out of contact with the fixing member, and the contact/retract unit separates the pressing member from the fixing member after completion of the fixing process by the pressing member and the fixing member.

Further, the aspect of the present invention resides in an image forming apparatus comprising: an image bearer for forming an electrostatic latent image on the surface thereof; a charger for charging the image bearer surface; an exposure device for forming an electrostatic latent image on the image bearer surface; a developing device for supplying toner to the electrostatic latent image on the image bearer surface to form a toner image; a transfer device for transferring the toner image from the image bearer surface to a recording medium; and a fixing device for fixing the transferred toner image to the recording medium, characterized in that the fixing device employs any one of the fixing devices defined in claims 1 to 7.

According to the present invention, in the fixing device for forming a lenticular lens structure when using a light-transmissive recording medium, including a fixing member for fusing an unfixed toner image on the recording medium and fixing the unfixed toner image onto the recording medium, a pressing member for conveying the recording medium while pressing the recording medium against the fixing member, a resin layer forming portion (e.g., an ejection nozzle) disposed in close proximity to the pressing member for forming a transparent resin layer by ejecting and applying a light-transmissive resin material on the surface of the pressing member; and a controller for controlling the operation of the resin layer forming portion, wherein the fixing member and the pressing member being put in pressure contact with each other to form a fixing nip portion so that while the recording medium is conveyed through the fixing nip portion by rotation of the fixing member and the pressing member, the unfixed toner image is fixed to the recording medium, wherein a plurality of grooves each having a concavely curved section and extending in the circumferential direction or in the rotational axial direction are formed in parallel to each other on the surface of the pressing member so as to create a lenticular lens structure on the pressing member side of a transparent resin layer formed by the resin layer forming portion, and, wherein, pressing the recording medium on one side of which an unfixed toner image is formed at the fixing nip portion between the fixing member and the pressing member, while transferring the transparent resin layer from the pressing member to the other side of the recording medium, the unfixed toner image is fixed on the one side of the recording medium while a lenticular lens is formed on the other side of the recording medium. Accordingly, it is possible for a space-saving device without the necessary of a large-scale apparatus to form a lenticular lens structure on the recording medium based on electrophotography in combination with a nozzle ejection technology, without causing any degradation of toner image quality.

Further, according to the present invention, since a lenticular lens structure can be applied as a uniform film on the recording medium, it is possible to form a lenticular image more excellent than that obtained by direct application over the recording medium surface.

According to the present invention, the pressing member is formed of a roller member having a metal core portion and a release layer disposed around the metal core portion, or an endless belt member, and the fixing member is formed of a roller member or an endless belt member. Accordingly, it is possible to prevent offset of recording mediums and provide a high-quality lenticular image. In this case, when a belt member is used for the pressing member or the fixing member, the warm-up time can be shortened so that it is possible to promptly enter sleep mode when no printing is carried out, hence realize a power-saving operation.

According to the present invention, a resin material that is solid at normal temperature is used as the light-transmissive, and the resin layer forming portion forms the transparent resin layer by a hot melt inkjet system including the steps of heating and fusing the light-transmissive resin material and ejecting the molten light-transmissive resin material toward the surface of the pressing member to form a light-transmissive resin layer on the surface of the pressing member. When, for example an ejection nozzle such as a spray nozzle, gun nozzle and the like is used, it is possible to apply a stable amount of light-transmissive resin material onto the target area only without producing any uneven layer thickness of the transparent resin layer.

According to the present invention, the fixing device further includes a layer thickness regulating member disposed at a position in close proximity to the outer periphery of the pressing member, upstream of the fixing nip portion and downstream of the resin layer forming portion with respect to the recording medium conveying direction, for regulating the thickness of the light-transmissive resin layer, and the controller includes a function of controlling the amount of ejection of the light-transmissive resin material from the resin layer forming portion in accordance with the thickness of the recording medium, a function of controlling the gap between the pressing roller and the layer thickness regulating member in accordance with the thickness of the recording medium and a function of controlling the temperature at the fixing nip portion in accordance with the thickness of the recording medium. As a result it is possible to create a lenticular lens in accordance with the thickness of the recording medium, hence the flexibility for forming a lenticular lens is enhanced.

If the thickness of the recording medium changes, the image focal length also changes, it is hence necessary to change the lens shape (the meniscus size). The invention is able to change the thickness of the lenticular lens by varying the amount of ejection of the light-transmissive resin material without changing the lens shape (the meniscus size).

That is, the thickness and density of the light-transmissive resin material on the pressing member are controlled by adjustment of the amount of ejection of the light-transmissive resin material by the resin layer forming portion and layer thickness control by the layer thickness regulating member while the temperature at the fixing nip portion is controlled, so as to realize uniform layer formation and prevention against offset and adjust the thickness of the lenticular lens in accordance with the thickness of the recording medium, thus making it possible to readily provide a highly qualified lenticular image.

According to the present invention, the light-transmissive resin material ejected from the hot melt inkjet system is composed of a light-transmissive resin and a wax having a phase change temperature of 60 deg.C or higher. Accordingly, the light-transmissive resin material promptly melts at the predetermined temperature (a temperature higher than the temperature at which lenticular lens sheets will not fuse with each other when one is laid over another), so that the fusibility becomes uniform, leading to energy saving. Further, the transparent resin layer (forming a lenticular lens) formed on the pressing member surface can be easily released from the pressing member surface, so that offset can be prevented from occurring. As a result, it is possible to inhibit diffusion of light and provide a highly qualified lenticular image by forming preferable convex meniscuses on the sheet surface for forming a lenticular lens without producing any unnecessary jaggedness.

According to the present invention, since the pressing member includes a heat source therein and fuses the light-transmissive resin material ejected and applied on the surface thereof, this improves fusibility of the light-transmissive resin material and promotes formation of a sheet with a uniform lenticular lens. As a result, it is possible to transfer and fix a uniform lenticular lens, hence provide a highly qualified lenticular image.

According to the present invention, since the fixing device further includes a contact/retract unit for bringing the pressing member into and out of contact with the fixing member, and the contact/retract unit separates the pressing member from the fixing member after completion of the fixing process by the pressing member and the fixing member, this configuration prevents damage to, and deterioration of, the surface of the fixing member, which would be caused by the pressing member surface having a jagged configuration due to formation of concave grooves, hence it is possible to lengthen the life of the fixing member.

According to the present invention, in an image forming apparatus comprising: an image bearer for forming an electrostatic latent image on the surface thereof; a charger for charging the image bearer surface; an exposure device for forming an electrostatic latent image on the image bearer surface; a developing device for supplying toner to the electrostatic latent image on the image bearer surface to form a toner image; a transfer device for transferring the toner image from the image bearer surface to a recording medium; and a fixing device for fixing the transferred toner image to the recording medium, the fixing device employs any one of the fixing devices defined in claims 1 to 7. As a result, it is possible for a space-saving device without the necessary of a large-scale apparatus to form a lenticular lens structure on the recording medium based on electrophotography in combination with a nozzle ejection technology, without causing any degradation of toner image quality.

DESCRIPTION OF THE PREFERRED EMBODIMENTS

Now, the embodied mode for carrying out the present invention will be described with reference to the drawings.

Figure 1:
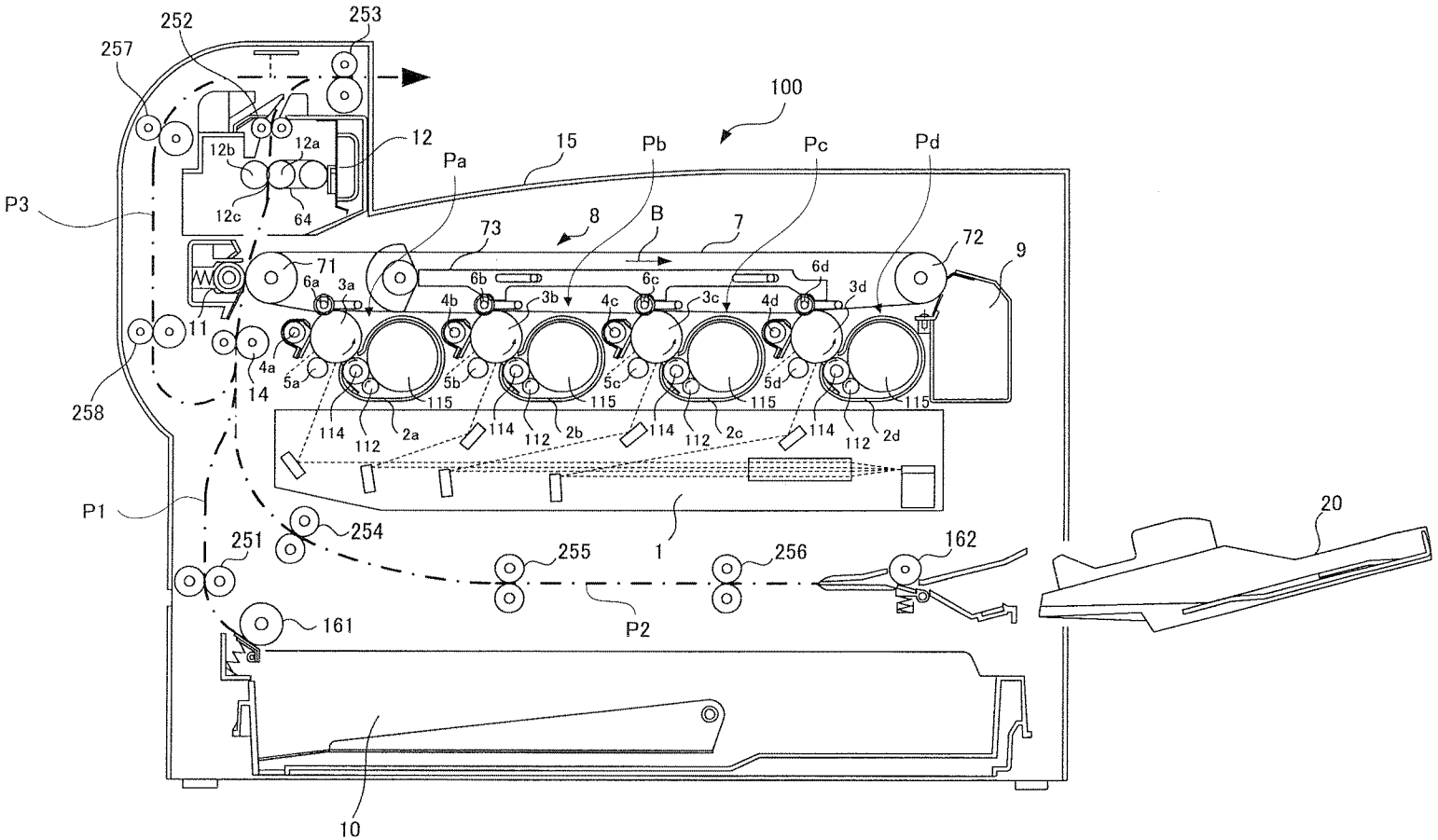
FIG. 1 is an illustrative diagram showing the overall configuration of an image forming apparatus according to the embodiment of the present invention.
Figure 2:
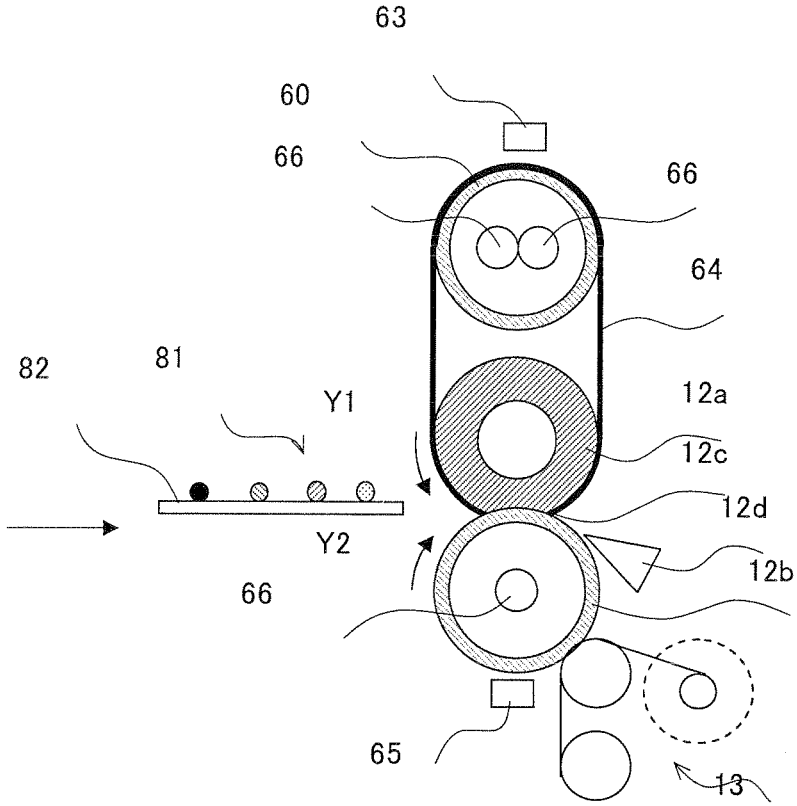
FIG. 2 is an illustrative diagram showing a configuration of a fixing device of the image forming apparatus.

FIG. 1 shows one example of a mode for carrying out the invention and is an illustrative diagram showing the overall configuration of an image forming apparatus according to the embodiment of the present invention. FIG. 2 is an illustrative diagram showing a configuration of a fixing device of the image forming apparatus.

An image forming apparatus 100 of the present embodiment includes: as shown in FIG. 1, photoreceptor drums 3 for forming electrostatic latent images on the surfaces thereof; chargers (charging devices) 5 for charging the photoreceptor drum 3 surfaces; an exposure unit (exposure device) 1 for forming electrostatic latent images on the photoreceptor drum 3 surfaces; developing devices 2 for supplying toners to the electrostatic latent images on the photoreceptor drum 3 surfaces to form toner images; an intermediate transfer belt unit (transfer device) 8 for transferring toner images from the photoreceptor drum 3 surfaces to a recording medium; and a fixing unit (fixing device) 12 for fixing the toner image to the recording medium. This image forming apparatus 100 that forms images with toners based on electrophotography, employs a characteristic fixing device configuration of the present invention as fixing unit 12, and forms a toner image on one side of a light transmissive recording medium and fixes an unfixed toner image to the recording medium surface while transferring and fixing a transparent resin layer to the surface opposite to that formed with an unfixed toner image to complete a lenticular lens structure.

This image forming apparatus 100 is an apparatus that forms multi-color or monochrome images on recording mediums in accordance with image data scanned from documents or image data transmitted via a network or the like.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 also includes exposure unit 1, fixing unit 12, a sheet conveyor passage (paper conveying paths) P1, P2 and P3 and a paper feed tray 10 and a paper output tray 15.

Photoreceptor drum 3 is a roller-like member that is rotatably supported and driven on an axis thereof by means of an unillustrated driver. Photoreceptor drum 3 is an image bearer which includes a photosensitive layer and bears an electrostatic latent image and hence a toner image on the surface of the photosensitive layer.

For example, photoreceptor drum 3 can be formed of a conductive substrate made of aluminum or the like and a surface. The conductive substrate may preferably use a sleeve-like, cylindrical or sheet-like conductive base. As the photosensitive layer, an organic photosensitive layer, inorganic photosensitive layer and the like can be considered. The organic photosensitive layer may be given as a lamination type in which a charge generating layer made of a resin containing a charge generating substance and a charge transport layer made of a resin containing a charge transport substance are laminated, may be given as a mono-layer type including both a charge generating substance and a charge transport substance in a single resin layer, or may be given as a resin lamination layer including one or more kinds of the resin layers in combination. It is also preferable that a primer layer is interposed between the conductive base and the photosensitive layer. It is also preferable that a surface layer (protective layer) is formed on the photosensitive layer surface in order to protect the photosensitive layer.

Charger 5 is a member that electrifies the photoreceptor drum 3 surface at a predetermined potential of a predetermined polarity.

This charger 5 is disposed along the longitudinal direction of photoreceptor drum 3 so as to oppose photoreceptor drum 3. When the charger is of a contact charging type, charger 5 is arranged in contact with the photoreceptor drum 3 surface. When the charger is a non-contact charging type, charger 5 is arranged apart from the photoreceptor drum 3 surface.

As charger 5, a brush-type charger, roller-type charger, corona discharge device, ion generator and the like can be used.

The brush-type charger and roller-type charger are of contact charging types. The corona discharge devices include various types, specifically, a type using a wire-like discharge electrode, a type using a serrated discharge electrode, a type using a needle-shaped electrode and the like.

Exposure unit 1 illuminates the surface of photoreceptor drums 3 that have been electrified, in accordance with image data of digital signals so as to form electrostatic latent images corresponding to the image data, on the surfaces of photoreceptor drums 3. Exposure unit 1 may use a semiconductor laser device or the like. Other than the laser scanning unit, arrays of light emitting elements such as EL (electroluminescence) and LED writing heads, may also be used as exposure unit 1.

Developing device 2 includes a developing roller 114 and agitating roller 112. Developing roller 114 is a roller-shaped member that is rotatably supported on its axis. Developing roller 114 is arranged with its part projected outwards from an opening of the developing device formed on the side opposing photoreceptor drum 3 so as to be placed close to the photoreceptor drum 3 surface.

Developing roller 114 incorporates unillustrated fixed magnetic poles, which support the developer on the surface of developing roller 114 by magnetism. Developing roller 114 supplies the carried developer to the electrostatic latent image on the surface of photoreceptor drum 3 in the close area (developing nip) between developing roller 114 and photoreceptor drum 3 to thereby form a toner image on the photoreceptor drum 3 surface. Developing roller 114 rotationally driven in the opposite direction to that of photoreceptor drum 3. Accordingly, in the developing nip area, the surface of developing device 114 and the surface of photoreceptor drum 3 move in the same direction.

Developing roller 114 is connected to an unillustrated power source and applied with a d.c. voltage (developing voltage) from the power source. By this application, the developer on the developer roller 114 surface is smoothly supplied to the electrostatic latent image. The applied voltage may be superimposed with an a.c. voltage.

Developing device 2 is a receptacle member having an interior space, and its one side opposing photoreceptor drum 3 is formed with the aforementioned opening. Developing device 2 includes agitating roller 112 in the interior space and stores the developer. As the developer, a usually used developer in this field can be used. Further, the developer may be a single component developer consisting of toner only, or may be a dual component developer made up of a toner and a carrier.

Agitating roller 112 is a screw-shaped member that is rotatably supported on its axis in the interior space of developing device 2. Agitating roller 112 is rotationally driven to bring the developer in developing device 2 to or the vicinity of developing roller 114.

A developer supply container 115 is a receptacle member for storing the developer in its interior space. Developer supply container 115 supplies the developer to developing device 2 in accordance with the state of consumption of the developer in the developing device 2.

Cleaner unit 4 removes and collects the developer left on the surface of photoreceptor drum 3 after the toner image on the photoreceptor drum 3 surface has been transferred to the recording medium.

Photoreceptor charge eraser (not illustrated) erases the electricity on photoreceptor drum 3 after the leftover developer has been collected by the drum cleaner. The photoreceptor charge eraser may employ lamps, LEDs or other illumination.

Intermediate transfer belt 7 is laid out over photoreceptor drums 3 and is tensioned between a drive roller 71 and a drive roller 72, forming a loop-like moving path. Photoreceptor drum 3*d*, photoreceptor drum 3*c*, photoreceptor drum 3*b* and photoreceptor drum 3*a* are arranged in this order so as to oppose the outer peripheral surface of intermediate transfer belt 7. Primary transfer rollers 6*a* to 6*d* are disposed at positions on the opposite side to respective photoreceptor drums 3*a* to 3*d* with the intermediate transfer belt 7 therebetween. The position at which intermediate transfer belt 7 opposes each of photoreceptor drums 3*a* to 3*d* forms a primary transfer station. Intermediate transfer belt 7 is formed of a film of about 100 to 150 μm thick.

In order to transfer the toner images carried on the surface of photoreceptor drums 3*a* to 3*d* to intermediate transfer belt 7, a primary transfer bias of a polarity opposite to the polarity of the electrostatic charge on the toner is applied to primary transfer rollers 6*a* to 6*d* by constant voltage control. By this voltage application the toner images of individual colors formed on photoreceptor drums 3*a* to 3*d* are successively transferred one over the other on the outer peripheral surface of intermediate transfer belt 7 so as to form a full-color toner image on the outer peripheral surface of intermediate transfer belt 7.

However, when image data for only part of four colors, yellow (Y), magenta (M), cyan (C) and black (K) is input, electrostatic latent images and hence toner images are formed on only the photoreceptor drums 3 that correspond to the colors of the input image data, among four photoreceptor drums 3*a* to 3*d*. For example, at the time of monochrome image forming, an electrostatic latent image and hence toner image is formed on only the photoreceptor drum 3*a* that corresponds to black color, and the black toner image alone is transferred to the outer peripheral surface of intermediate transfer belt 7.

Each of primary transfer rollers 6*a* to 6*d* is formed of a base shaft made of stainless steel having a diameter of 8 to 10 mm and a conductive material (e.g., EPDM, foamed urethane or the like) coated on the shaft surface. This conductive elastic material contributes to uniform application of a high-voltage to intermediate transfer belt 7.

The toner image transferred to the outer peripheral surface of intermediate transfer belt 7 at each primary transfer station is conveyed by rotation of intermediate transfer belt 7 to the secondary transfer station that opposes a secondary transfer roller 11. The secondary transfer roller 11 is put into pressure contact with the outer peripheral surface of intermediate transfer belt 7 under a predetermined nipping pressure, at the position where the belt's inner peripheral surface is put in contact with the peripheral surface of drive roller 71. With this arrangement, a high voltage of a polarity opposite to the polarity of the electrostatic charge on the toner is applied to secondary transfer roller 11 when the recording medium fed from a paper feed cassette 10 or a manual paper feed tray 20 passes through the nip between secondary transfer roller 11 and intermediate transfer belt 7. As a result, the toner image is transferred from the outer peripheral surface of intermediate transfer belt 7 to the recording medium surface.

Of the toner adhering from photoreceptor drums 3 to intermediate transfer belt 7, the toner that has not been transferred to the recording medium but remains on intermediate transfer belt 7 is collected by a transfer cleaning unit 9 in order to prevent contamination of colors in the next operation.

The recording medium with the toner image transferred thereon is lead to fixing unit 12, and heated and pressurized by being passed through a fixing nip portion 12*c* formed between a fixing belt 64 tensioned between a fixing roller 12*a* and a heating roller 60 and a pressing roller 12*b*. As a result, the toner image is robustly fixed to the recording medium surface. The recording medium fixed with the toner image is discharged onto paper output tray 15 by means of a paper output roller 253.

Arranged in image forming apparatus 100 is a paper conveying passage P1 that extends in an approximately vertical direction in order to convey a recording medium stored in paper feed cassette 10 through the nip between secondary transfer roller 11 and intermediate transfer belt 7 and fixing unit 12 to paper output tray 15.

Arranged along paper conveying passage P1 are a pickup roller 161 for delivering sheet-like recording mediums one sheet at a time from paper feed cassette 10 to paper conveying passage P1, conveying rollers 251 for conveying the delivered recording medium upwards, a registration roller 14 that leads the conveyed recording medium towards the nip between secondary transfer roller 11 and intermediate transfer belt 7 at a predetermined timing, and paper output roller 253 for discharging the recording medium to paper output tray 15.

Also, a paper conveying passage P2 along which a pickup roller 162, conveying rollers 254, 255 and 256 are laid out is formed from manual paper feed tray 20 to registration roller 14. Further, a paper conveying passage P3 is formed from paper output roller 253 to the upstream side of registration roller 14 in paper conveying passage P1.

Paper output roller 253 is adapted to rotate in both forward and reverse directions. The paper output roller is turned in the forward direction so as to discharge the recording medium to paper output tray 15, in one-sided image forming mode in which image forming is performed on one side of the recording medium and when image forming is performed on the second side of the recording medium in duplex image forming mode in which images are formed on both sides of the recording medium. On the other hand, at the time of image forming on the first side in the duplex image forming mode, paper output roller 253 is driven in the forward direction until the rear end of the recording medium passes through fixing unit 12 and then driven in reverse from the state in which the paper output rollers hold the rear end of the recording medium, so as to lead the recording medium into paper conveying passage P3. As a result, the recording medium with an image formed on one side in the duplex image forming mode is turned upside down with the front side inverted to the rear, and drawn to paper conveying passage P1 by means of conveying rollers 257 and 258.

Registration roller 14 delivers the recording medium, fed from paper feed cassette 10, or manual paper feed tray 20, or conveyed by way of paper conveying passage P3, to the nip between secondary transfer roller 11 and intermediate transfer belt 7 at a timing in synchronization with the rotation of intermediate transfer belt 7. For this purpose, registration roller 14 is suspended to rotate when photoreceptor drums 3 and intermediate transfer belt 7 start operating, and the recording medium that has been fed or conveyed ahead of the rotation of intermediate transfer belt 7, puts its front edge against registration roller 14 and stops moving in paper conveying passage P1. Then, registration roller 14 starts rotating at such a timing that the front end of the recording paper and the front end of the toner image formed on intermediate transfer belt 7 will meet each other at the pressure nip between secondary transfer roller 11 and intermediate transfer belt 7.

Here, in full-color image forming mode in which all the image forming portions Pa to Pd are used to perform image forming, primary transfer rollers 6*a* to 6*d* are caused to bring intermediate transfer belt 7 into pressing contact with all the photoreceptor drums 3*a* to 3*d*. On the other hand, in monochrome image forming mode in which image forming portion Pa alone is used to perform image forming, primary transfer roller 6*a* alone is caused to press intermediate transfer belt 7 against photoreceptor drum 3*a*.

Fixing unit 12 includes, as shown in FIG. 2, fixing roller 12*a*, pressing roller 12*b*, fixing belt 64 and heat roller 60 as a heating member. Arranged inside heat roller 60 is a heater lamp 66 for heating heat roller 60. Fixing belt 64 is suspended between fixing roller 12*a* and heat roller 60 while pressing roller 12*b* is arranged so as to oppose fixing roller 12*a* with fixing belt 64 in between.

Designated at a reference numeral 12*d* is a separation claw that peels off the recording medium stuck to pressing roller 12*b*.

Fixing roller 12*a* and heat roller 60 are arranged approximately parallel to each other in the axial direction of fixing roller 12*a*. Accordingly, when fixing belt 64 suspended between fixing roller 12*a* and heat roller 60 moves whilst sliding, it is possible to prevent the belt from traveling in a skewed manner and keep durability of fixing belt 64 high.

Fixing unit 12 is a fixing device in which heat roller 60 comes in contact with fixing belt 64 to heat fixing belt 64, and when a recording medium, designated at 82, passes through fixing nip portion 12*c* formed between fixing belt 64 and pressing roller 12*b*, at a predetermined fixing speed and copy speed, the unfixed toner image, designated at 81, supported on recording medium 82 is heated and pressed on recording medium 82 to thereby achieve fixing.

Here, unfixed toner image 81 may be formed of a developer (toner) such as, for example, a non-magnetic mono component developer (non-magnetic toner), non-magnetic dual component developer (non-magnetic toner and carrier), magnetic developer (magnetic toner) or the like. The fixing speed is the so-called process speed, and the copy speed means the number of copies per minute.

Fixing belt 64 is arranged so as to abut the toner image supporting side of recording medium 82 when recording medium 82 passes through fixing nip portion 12*c*.

Fixing roller 12*a* is rotatably arranged on its rotation axis so as to oppose pressing roller 12*b* with fixing belt 64 in between whilst forming fixing nip portion 12*c* by abutting fixing belt 64 against pressing roller 12*b*. Fixing roller 12*a* is driven by rotation of pressing roller 12*b* to rotate in a rotational direction Y1.

Detailedly, fixing roller 12*a* is 30 mm in diameter, has a two-layered structure composed of a metal core and an elastic layer in this order from the interior side. The metal core may be formed of a metal such as iron, stainless steel, aluminum, copper or the like, or an alloy of these. As the elastic layer, heat-resistant rubber material such as silicone rubber, fluoro rubber or the like is preferably used. In the present embodiment, the force of fixing roller 12*a* pressing on pressing roller 12*b* via fixing belt 64 is about 216 N.

Pressing roller 12*b* is rotationally driven in a rotational direction of Y2 about the rotational axis by means of an unillustrated drive motor (driver) to convey fixing belt 64.

Detailedly, pressing roller 12*b* has a two-layered structure composed of a metal core and a release layer in this order from the interior side. The metal core may be formed of a metal such as iron, stainless steel, aluminum, copper or the like, or an alloy of these. As the release layer of the pressing roller, fluoro resins such as PFA (tetra fluoro ethylene-perfluoro alkylvinyl ether copolymer), PTFE (polytetrafluoroethylene) and the like are preferably used. A heater lamp 66 for heating pressing roller 12*b* is arranged inside pressing roller 12*b*.

Further, a cleaning mechanism 13 for removing toner adhering to pressing roller 12*b* is provided at a position around pressing roller 12*b*.

When the main controller (not shown) for controlling the operation of image forming apparatus 100 instructs a power source circuit to supply power to or energize heater lamp 66, heater lamp 66 emits light and radiates infrared rays. As a result, the interior surface of pressing roller 12*b* absorbs infrared rays and heats so that pressing roller 12*b* is heated as a whole.

Fixing belt 64 is an endless belt having a diameter of 50 mm and being suspended between heat roller 60 and fixing roller 12*a*, and wound on fixing roller 12*a* at a predetermined angle.

Detailedly, fixing belt 64 has a three-layered structure composed of a hollow cylindrical base made of a heat-resistant resin such as polyimide or the like or a metal such as stainless steel, nickel or the like, an elastomeric material (e.g. silicone rubber) that is excellent in heat-resistance and resiliency, formed as an elastic layer on the base, and a synthetic resin material (e.g., fluoro resins such as PFA, PTFE and the like) that is excellent in heat resistance and releasability, formed as a release layer on the topmost surface. It is also possible to internally add fluoro resin into the base made of polyimide. With this configuration, it is possible to reduce sliding load with heat roller 60.

Fixing belt 64 is driven by fixing roller 12*a* as the fixing roller rotates, to rotate in the rotational direction Y1. Then, fixing belt 64 is heated at a predetermined temperature by heat roller 60 and heats unfixed toner image 81 and recording medium 82 that pass through fixing nip portion 12*c*.

Fixing unit 12 further includes as temperature detectors a heater side thermistor 63 arranged around the peripheral side of fixing belt 64 and a pressing roller side thermistor 63 arranged around the peripheral side of pressing roller 12*b* so as to detect respective surface temperature. Based on the surface temperature of fixing belt 64 detected by heater side thermistor 63, electric current through the heat source (heater lamp) is controlled.

Heater side thermistor 63 in the present embodiment is a non-contact type temperature detector, specifically using an infrared detection type temperature sensor.

If a contact type temperature detector is arranged in contact with fixing belt 64, there is a risk that the contact type temperature detector abrades the surface layer, or the release layer of fixing belt 64 at the interface where the sensor comes in contact with fixing belt 64. Once the surface release layer of fixing belt 64 is damaged or degraded, the damage will cause had influence on images, producing images of poor quality.

Also, based on the surface temperature of pressing roller 12*b* detected by pressing roller side thermistor 65, electric current through heater lamp 66 is controlled. This pressing roller side thermistor 65 may use a contact type temperature detector.

Now, the toner used for image forming apparatus 100 of the present embodiment will be described.

As the binder resin of the toner used for image forming apparatus 100, polystyrene resin, resin consisting of a homopolymer of a styrene substitution product, copolymer resin obtained by polymerization of a styrene monomer and an acrylic monomer, acrylic copolymer resin, polyvinyl acetate resin, cyclo olefin copolymer as a copolymer of norbornene and ethylene, polyethylene resin, polypropylene resin, polyester resin, polyurethane resin and the like can be considered.

These binder resins may be used alone or in combination of two or more kinds.

Since the binder resin for toner is required to be excellent in preservability and durability, of the above binder resins binder resins having a softening point of 100 to 150 deg.C and a glass transition point of 50 to 80 deg.C are preferable, in particular, polyester resins whose softening point and glass transition point fall within the above ranges are preferable. In view of transparency, cyclo olefin copolymer is also preferable.

The release agent for toner is not particularly limited. For example, wax can be used. It is possible to use a wax that is usually used in the field of ordinary electrophotographic image forming. For example, polyethylene wax, polypropylene wax, paraffin wax, ester wax, etc. can be considered.

The content of the release agent is not particularly limited as long as it falls within the normally used range.

Other than the binder resin and release agent, typical toner additives such as charge control agents etc., may be included.

The charge control agent is not particularly limited as long as it can electrify toner or can control the electric charge on the toner. However, it is preferable that the charge control agent will not affect the transparency of the toner. Examples of the charge control agent include nigrosine dye, quaternary sulfonium slats, triphenyl methane derivatives, zinc salicylate complex, zinc naphtol acid complex, metal oxides of benzilic acid derivatives and the like. These charge control agent may be used alone or in combination of two or more kinds.

The content of the charge control agent is not particularly limited as long as it falls within the normally used range.

The toner can be manufactured following a conventionally known method of toner particles. For example, pulverization, suspension polymerization, emulsion polymerization and the like can be exemplified.

The volume mean particle diameter of the toner is not particular limited, but preferably falls within the range of 2 μm to 10 μm. If the volume mean particle diameter is smaller than 2 μm, the resultant toner becomes poor in fluidity. Resultantly, toner supply, agitation and electrification become insufficient, causing shortage in the amount of toner, increase of reversely electrified toner and other defects in developing operation. As a result, trouble that satisfactory toner images cannot be obtained and other problems may occur. On the other hand, when the volume mean particle diameter is greater than 10 μm, trouble that formation of output images at high resolution is impeded and other problems will occur.

External additives are added aiming at improvement in powder fluidity, improvement in tribo-electrification, improvement in heat resistance, improvement in long preservability, improvement in cleaning performance, control on abrasion characteristic of the photoreceptor surface and providing other functions. Specific examples of external additives usually used in this field include silica, alumina, titanium oxide, acrylic resin particles, metallic soap particles and the like. The content is not particularly limited as long as it falls within the normally used range.

The thus manufactured toner may be directly used as a mono-component developer, or may also be mixed with a carrier particle so as to be used as a dual-component developer.

As the carrier particle used for a dual component developer is not particularly limited, and carrier particles that are usually used in this field can be used. For example, carriers composed of magnetic materials such as iron, nickel, cobalt, etc.; and carriers composed of magnetic oxides such as ferrite, magnetite, etc. are preferably used. Further, these carrier particles coated with a resin material may also be used. Any of these carriers may be selected as appropriate in accordance with the toner component, and may be used alone or in combination of two or more kinds. The particle diameter of the carrier particle is not particularly limited, but in order to obtain uniform electrification and images, it is preferable to specify the particle diameter within a range of 30 μm to 100 μm.

The manufacturing method of a dual component developer is not particularly limited, and conventionally publicly known methods can be used. The toner of the present embodiment is preferably included in an amount of 3% to 20% by weight to the total amount of the dual component developer.

Next, the characteristic configuration of fixing unit 12 according to the present embodiment will be described in detail with reference to the drawings.

Figure 3:
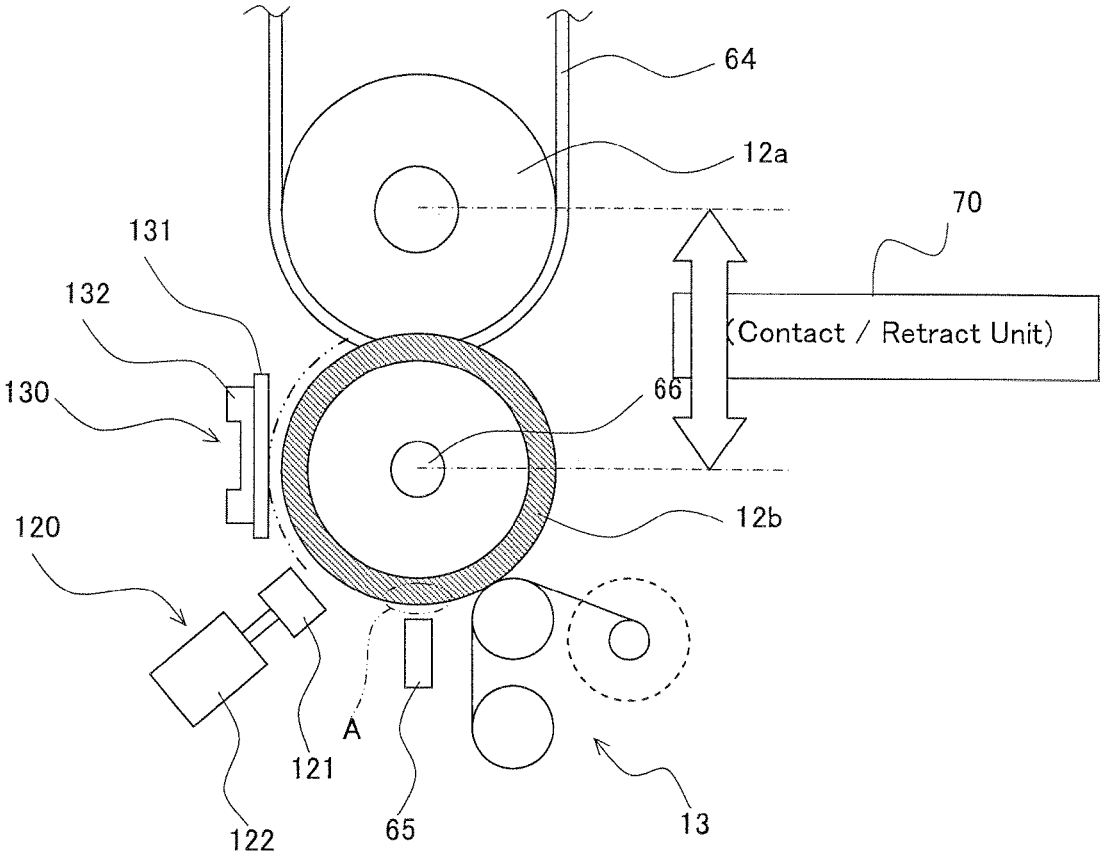
FIG. 3 is an illustrative diagram showing a characteristic configuration of a fixing unit according to the present embodiment.
Figure 4:
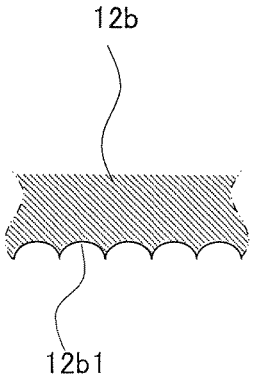
FIG. 4 is an enlarged diagram showing the detail of part A in FIG. 3.
Figure 5:
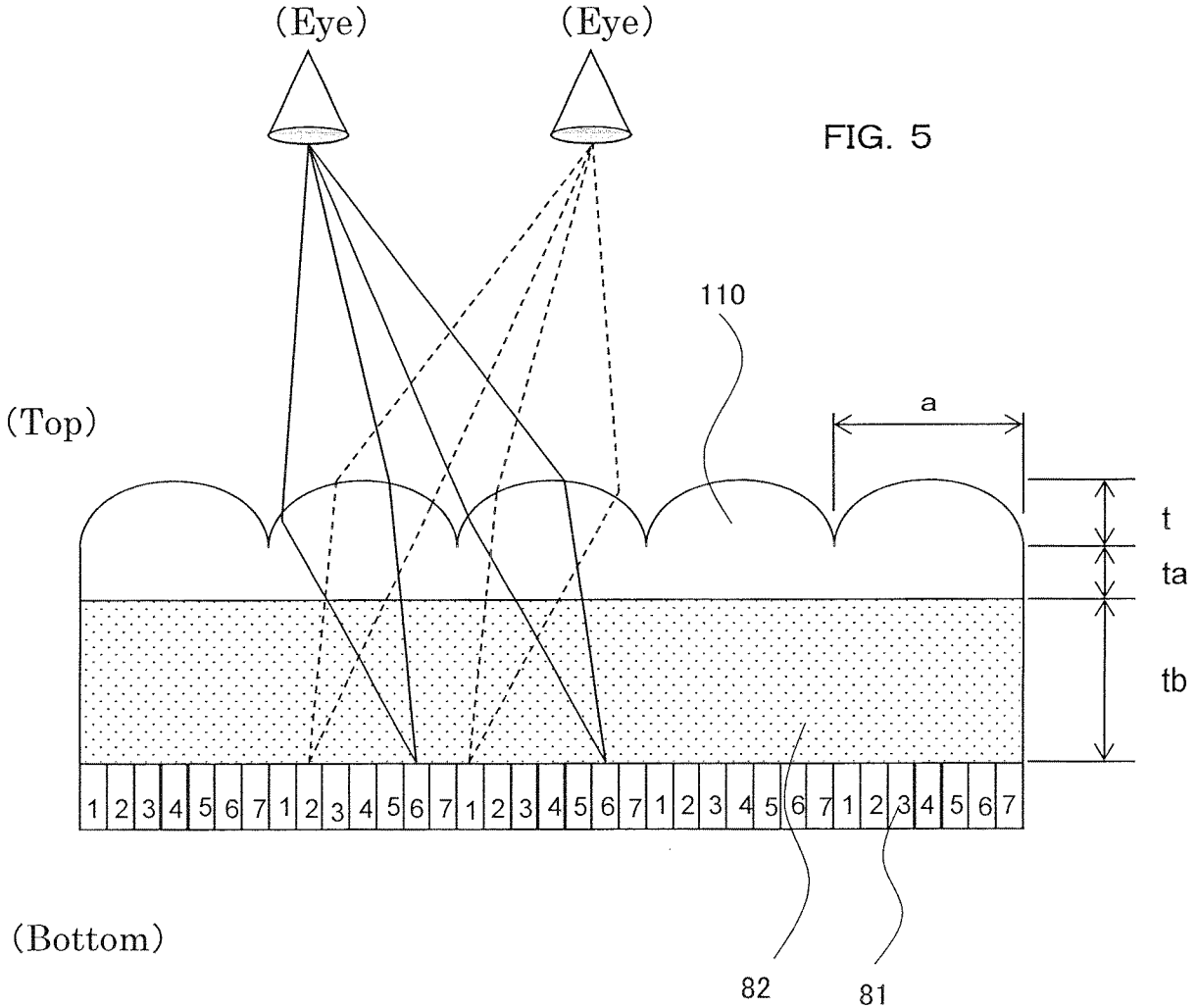
FIG. 5 is an illustrative diagram showing a configuration of an lenticular image formed by the fixing unit.

FIG. 3 is an illustrative diagram showing a characteristic configuration of a fixing unit of the image forming apparatus according to the present embodiment. FIG. 4 is an enlarged diagram showing the detail of part A in FIG. 3. FIG. 5 is an illustrative diagram showing a configuration of an lenticular image formed by the fixing unit.

Fixing unit 12 of the present embodiment is configured to form a lenticular lens on the surface of a transparent recording medium (light transmissive substrate, e.g., PET sheet, etc.) in parallel to fix a toner image onto the recording medium.

Specifically, as shown in FIG. 3, fixing unit 12 includes fixing belt 64, heat roller 60 (see FIG. 2) as a heat source, fixing roller 12*a*, pressing roller 12*b*, a resin layer forming device (resin layer forming portion) 120, a layer thickness regulating device (layer thickness regulating member) 130, a contact/retract device 70 for controlling contact and separation between fixing roller 12*a* and pressing roller 12*b*.

In this fixing unit 12, heat roller 60 heats fixing belt 64, which heats and presses the unfixed toner image supported on a recording medium at the fixing nip portion 12*c* between fixing roller 12*a* and pressing roller 12*b* so that the toner image is fixed to the recording medium as the recording medium passes through the nip at the predetermined fixing speed and copy speed. At the same time, a molten lens forming material (light transmissive resin material) is ejected onto the pressing roller surface at a position on the upstream side of fixing nip portion 12*c* with respect to the rotational direction so as to form a lens forming material layer (transparent resin layer). The lens forming material layer is transferred from the pressing roller to the recording medium at the fixing nip portion 12*c* to thereby form a lenticular lens on the recording medium.

Pressing roller 12*b* is supported at both ends with respect to the axial direction and rotatably driven by an unillustrated drive source. Pressing roller 12*b* incorporates heater lamp 66 as a heat source so as to fuse the light-transmissive resin material applied on the surface thereof.

Further, pressing roller 12*b* has a structure including a metal core and a release layer.

As the material for the metal core, aluminum, iron, stainless steel or the like can be used. The metal core has a straight cylindrical form, which either may have, or need not have, a tapered structure at both ends with respect to the axial direction thereof.

As the material for the release layer of the pressing roller, fluoro resins such as PFA (tetra fluoro ethylene-perfluoro alkylvinyl ether copolymer), PTFE (polytetrafluoroethylene) and the like can be considered. Also, DLC (diamond-like carbon) including these fluoro resin or the like can be used. Here, the thickness of the release layer is preferably from 10 μm to 50 μm. Thinning the release layer less than 10 μm creates a durability problem. On the other hand, if the release layer is thicker than 50 μm, grooves in the jagged configuration become shallow, posing the problem that the lens cannot be well formed.

In order to assure releasability of the release layer, a release agent such as silicone oil or the like may be applied. For this, a silicone oil having a viscosity of about 1,000 cs to 10,000 cs can be used.

Pressing roller 12*b* is a lens-forming roller having an outer peripheral surface on which a plurality of grooves 12*b*1 each having a concavely curved section and extending along the rotational axis and are formed parallel to each other, as shown in FIG. 4. As a transparent resin layer 110 that is formed across these grooves 12*b*1 by applying the light-transmissive resin material from resin layer forming device 120, is transferred to recording medium 82, a lenticular lens 110 made of the transparent resin layer that is projected to the pressing roller 12*b* side (the groove 12*b*1 side) is formed on the recording medium surface, as shown in FIG. 5.

In this lenticular lens 110, a symbol 'a' designates the dimension of the pitch with which projected lens elements are formed, 't' the height of the lens element, 'ta' the height of the base of the lens element, and 'tb' the thickness of the recording medium.

As a manufacturing method of grooves 12*b*1, a mechanical process using a metallic bit, shaping using laser, etching and the like can be considered. The present invention should not be limited to the groove manufacturing method. This groove 12*b*1 may be formed either in the axial direction (longitudinal direction) of pressing roller 12*b* as in the present embodiment, or in the circumferential direction of pressing roller 12*b*.

Though, in the present embodiment, pressing roller 12*b* is constructed as a lens-forming roller, the configuration of the lens-forming member should not be limited to the roller form.

For example, if the pressing assembly is configured so that pressing is carried out by a pressing roller via a belt member, the belt member can be used as a lens-forming element. In this case, use of a belt member can reduce the heat capacity, hence making it possible to shorten the warm-up time.

Resin layer forming device 120 includes a lens-forming material bottle 121 for holding the light-transmissive resin material and a nozzle 122 that ejects the molten light-transmissive resin material. Nozzle 122 is arranged in close proximity to the outer periphery of pressing roller 12*b*.

This resin layer forming device 120 forms a transparent resin layer, by using a hot melt inkjet system including the steps of heating and fusing a light-transmissive resin material and ejecting the molten light-transmissive resin material toward the surface of pressing roller 12*b* to form a light-transmissive resin layer on the surface of pressing roller 12*b*.

In the hot melt inkjet system, since the light-transmissive resin that forms the lens is handled in a solid state at room temperature, it is possible to assure both preservation stability and heat processibility to be required for a lens-forming material, thanks to handling the material in a powdery form like toner.

Nozzle 122 can use a nozzle head that is usually used in hot melt inkjet systems. In order to make the ejection of the light-transmissive resin material from the nozzle cope with the rotational speed of pressing roller 12*b* and fixing roller 12*a*, it is preferable to use a line head that can perform a wide range of ejection along the rotational axis.

The light-transmissive resin material (light-transmissive resin composition) ejected from resin layer forming device 120 based on a hot melt inkjet system may consist of a light-transmissive resin and wax, and is preferably solid at normal temperature and has a phase change temperature of 60 deg.C or higher.

The light-transmissive resin may employ polyamide resin, polyester resin and the like.

As a polyamide resin, Versamid 711, Versamid 725, Versamid 930, Versamid 940, Versalon 1117, Versalon 1138, Versalon 1300, Tohmide 391, Tohmide 393, Tohmide 394, Tohmide 395, Tohmide 397, Tohmide 509, Tohmide 535, Tohmide 558, Tohmide 560, Tohmide 1310, Tohmide 1396, Tohmide 90 and Tohmide 92 may be used. As a polyester resin, KTR 2150, polyester resin for toner and the like may be selected.

In order to promote heat fusibility and assure releasability of the light-transmissive resin material, it is preferable to add wax. As the wax, from paraffin wax selected from petroleum waxes, micro-crystalline wax, carnauba wax, montan wax, at least one kind can be selected or two or more kinds of wax may be mixed for use.

Further, other than the above resin and wax, it is possible to mix other additives such as fatty acids, various kinds of surface control agents, surfactant, viscosity reducer, antioxidant, preservative, etc. as long as they are compatible with the lens forming composition. If the phase change temperature is lower than 60 deg.C, there occurs a problem of lamination at high temperature when a lens sheet is overlaid. If the phase change temperature is much higher than the ejection temperature, high power is needed for heating. Further, since the toner is fixed at the same time, the toner fixing temperature becomes too high, causing trouble in toner fixing such as offset, winding of recording paper on the fixing roller and other problems.

Layer thickness regulating device 130 is comprised of a layer thickness regulator 131 for regulating the thickness of the light-transmissive resin layer and a presser 132 for setting the gap between layer thickness regulator 131 and pressing roller 12*b* by actuating the layer thickness regulator 131, and is disposed at a position in close proximity to the outer periphery of pressing roller 12*b*, upstream of fixing nip portion 12*c* and downstream of resin layer forming device 120 with respect to the conveying direction of recording mediums.

Contact/separation device 70 is configured to separate pressing roller 12*b* from fixing roller 12*a* after completion of the fixing process by fixing roller 12*a* and pressing roller 12*b*.

Since pressing roller 12*b* is separated from fixing roller 12*a* by contact/retract device 70 after completion of lenticular lens formation and toner fixing, fixing nip portion 12*c* is freed so that grooves 12*b*1 formed on pressing roller 12*b* is released from the high-temperature pressurized condition. Accordingly, it is possible to lengthen the life of fixing unit 12 without causing any damage to grooves 12*b*1 on pressing roller 12*b* and the fixing belt 64 surface opposing to the grooves.

Though in the present embodiment fixing unit 12 uses fixing belt 64 as a fixing structure to bring pressing roller 12*b* into pressure contact with fixing roller 12*a* via fixing belt 64, the configuration of fixing unit 12 should not be limited to this.

A variational example of a fixing unit 12 of the present embodiment will be shown hereinbelow.

Figure 7:
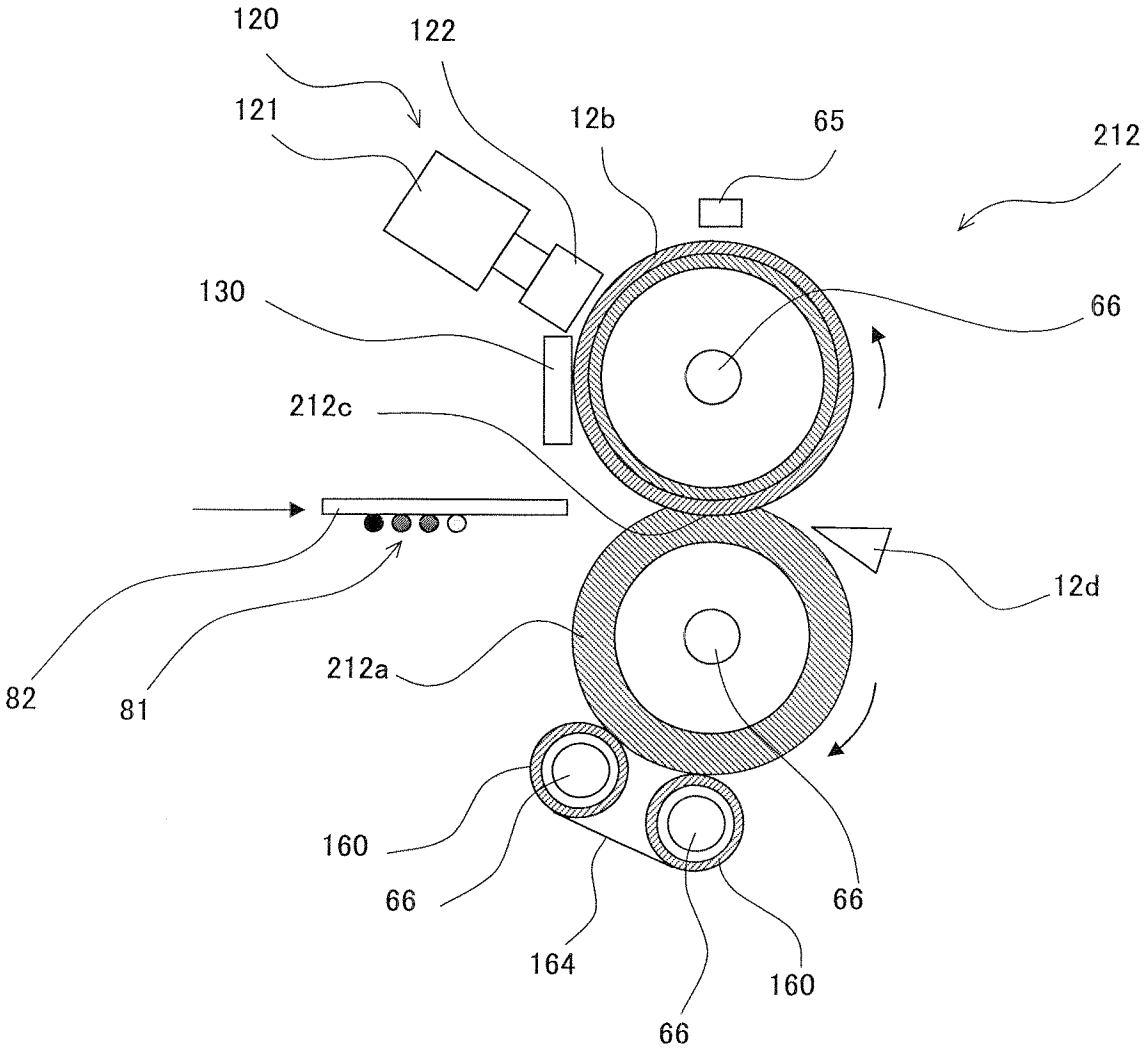

FIG. 7 is an illustrative diagram showing a configuration of a variational example of a fixing unit of the present embodiment.

As shown in FIG. 7 a fixing unit 212 of this variational example uses a rotatable fixing roller 212*a* of a roll shape as a fixing member, with which pressing roller 12*b* is put into pressure contact by an unillustrated pressing mechanism.

Fixing roller 212*a* has a configuration including a metal core, an elastic layer and a release layer.

As the material for the metal core, for example aluminum, iron, stainless steel and the like can be used. The metal core has a straight cylindrical shape, and either may have, or need not have, a tapered structure at both ends with respect to the axial direction thereof.

The elastic layer is provided on the outer peripheral surface of the metal core in order to enlarge a fixing nip portion 212*c* formed between pressing roller 12*b* and 212*a*. As the material for the elastic layer, ones having rubber elasticity, preferably ones having rubber elasticity and excellent in heat resistance may be used. Specific examples include silicone rubber, fluoro rubber, fluoro-modified silicone rubber and the like. These materials may be used also in foamed condition. In particular, silicone rubber that is excellent in rubber elasticity is preferred.

The release layer is formed on the outer peripheral surface of the elastic layer. Used as the material for the elastic layer may be one that is excellent in heat resistance and durability and having weak adhesion to toner. As the material for this release layer, the same materials as those for the release layer of the aforementioned pressing roller 12*b* may be considered. When PFA or PTFE is used, the material in a tubular form may be covered or the material may be coated. The release layer may be preferably 10 to 50 μm thick. If it is thinner than 10 μm, there occur durability problems. Conversely, if the release layer is thicker than 50 μm, the jagged configuration of the grooves becomes shallow so that the necessary lens configuration cannot be well formed.

Next, a characteristic configuration of the control system for fixing unit 12 of image forming apparatus 100 of the present embodiment will be described with reference to a block diagram.

Figure 6:
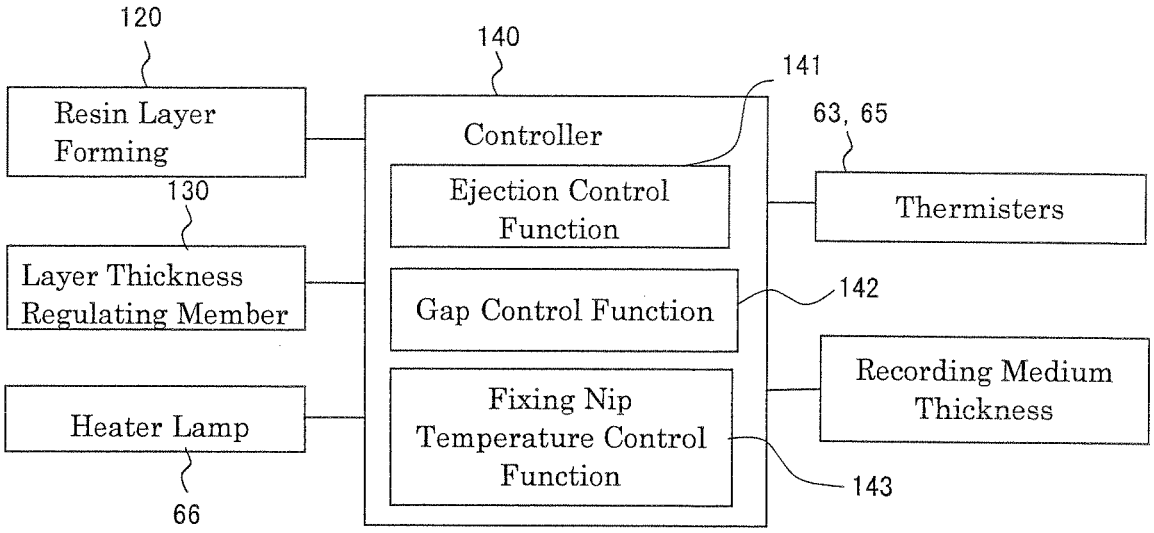
FIG. 6 is a block diagram showing a control system configuration of a fixing unit of the image forming apparatus; and, FIG. 7 is an illustrative diagram showing a configuration of a variational example of a fixing unit of the present embodiment.

FIG. 6 is a block diagram showing a control system configuration of a fixing unit of the image forming apparatus of the present embodiment.

In fixing unit 12 of image forming apparatus 100, a controller 140 performs operation control of resin layer forming device 120 and layer thickness regulating device 130 and temperature control of fixing roller 12*a* and pressing roller 12*b*, as shown in FIG. 6.

Controller 140 includes an ejection control function 141 for controlling the amount of ejection of light-transmissive resin material from resin layer forming device 120 in accordance with the thickness of the recording medium, a gap control function 142 for controlling the movement of presser 132 in accordance with the thickness of the recording medium to control the gap between pressing roller 12*b* and layer thickness regulator 131 and a fixing nip temperature control function 143 for controlling the temperature at fixing nip portion 12*c* in accordance with the thickness of the recording medium.

Ejection control function 141 controls the amount of ejection of light-transmissive resin material ejected from nozzle 122 of resin layer forming device 120 in accordance with the thickness of the recording medium.

Gap control function 142 adjusts the gap between pressing roller 12*b* and layer thickness regulator 131 in accordance with the thickness of the recording medium to thereby control the thickness of the light-transmissive resin layer formed by the light-transmissive resin material.

Fixing nip temperature control function 143 controls the temperature at fixing nip portion 12*c* by controlling ON/OFF (illumination) of heater lamp 66 in accordance with the temperature of the fixing belt and the temperature pressing roller 12*b*, detected by heater side thermistor 63 and pressing roller side thermistor 65.

Though in the present embodiment, controller 140 is provided as the controller for controlling the operation of fixing unit 12, the main controller (not shown) for controlling the operation of image forming apparatus 100 may be equipped with the function of controlling the operations of resin layer forming device 120, layer thickness regulating device 130 and the like.

Next, examples of forming a lenticular image by providing a lenticular lens on a sheet of transparent recording medium using fixing unit 12 will be described.

EXAMPLE 1

In example 1, fixing unit 12 shown in FIG. 3 was set as the fixing device of a multi-functional machine (Model: MX4500FN, a product of Sharp Corporation), and a lenticular image was formed.

The composition of the toner used includes:

a binder resin: polyester resin (94.5 parts);

a charge control agent: metal oxides of benzilic acid derivatives (0.5 part);

a wax: polyethylene wax (5.0 parts); and external additives:

1.0 part of small-diametric silica to the amount of toner, and 1.5 parts of titanium oxide to the amount of toner.

The developer is formulated as a dual component developer including the toner at a ratio of 8% to the total amount of developer.

Pressing roller 12*b* as a lens forming roller was formed of a metal core of aluminum with both ends tapered and sized so as to have an outside diameter of 30 mm, an inside diameter of 0.5 mm and a barrel length of 315 mm. Formed across a width of 300 mm on the surface of the roller were grooves each having a concavely curved section of 40 μm deep and shaped by laser with a pitch of about 120 μm with respect to the roller's circumferential direction.

The surface of pressing roller 12*b* was coated with fluoro resin of about 10 μm thick in order to assure releasability for the light-transmissive resin material as a lens forming resin composition.

Fixing belt 64 was wound on fixing roller 12*a* having an outside diameter of 50 mm and formed of polyamide of 70 μm thick as the base layer, silicon rubber of 150 μm thick as the elastic layer and PFA coating of 20 μm thick as the surface layer.

A halogen lamp was provided as heater lamp 66 inside each of fixing roller 12*a* and pressing roller (lens forming roller) 12*b* in order to heat the rollers from their interior.

The composition of the light-transmissive resin material as the lens forming material includes:

a resin: polyester resin (glass transition point: 60 deg.C) (57 parts); and, a wax: carnauba wax (melting point: 60 deg.C) (43 parts).

As the transparent recording medium, an A4 size PET sheet of about 130 μm thick was used.

After forming a toner layer of about 20 μm thick on the light-transmissive base, the light-transmissive resin material heated at an ejection temperature of 130 deg.C was ejected onto the pressing roller 12*b* surface from a line head nozzle as nozzle 122 opposing pressing roller 12*b* while the recording medium was being conveyed at a conveying speed (rotational speed) of 50 mm/sec through the nip between fixing belt 64 set at a surface temperature of about 170 deg.C and pressing roller 12*b* set at a surface temperature of about 120 deg.C, whereby a lenticular lens was formed on the PET sheet surface while the toner image was fixed on the opposite side.

As a result, an A4 size lenticular image having lens elements of about 30 μm high arranged on the whole surface with a pitch of 120 μm was readily formed.

EXAMPLE 2

In example 2, fixing unit 212 shown in FIG. 7 was used as the fixing device, and a lenticular image was formed.

The composition of the toner used was the same as that of example 1.

As a lens forming roller, pressing roller 12*b* formed of an aluminum roller having an outside diameter of 40 mm, a wall thickness of 2 mm and a barrel length of 315 mm was used. Grooves each having a concavely curved section of 30 μm deep were mechanically shaped across a width of about 300 mm on the surface of the roller, with a pitch of about 250 μm with respect to the roller's circumferential direction.

The surface of pressing roller 12*b* was coated with fluoro resin of about 10 μm thick in order to assure releasability for the light-transmissive resin material as a lens forming resin composition.

Fixing belt 212*a* is formed of a hollowed aluminum core having an outside diameter of 29.8 mm, an inside diameter of 23.8 mm and a wall thickness of 3 mm, a silicone rubber layer of 3 mm thick provided as the elastic body and a PFA tube layer of 50 μm thick provided as the release layer on the top surface.

A halogen lamp was provided as heater lamp 66 inside each of pressing roller 12*b*, fixing roller 212*a*, heating rollers 160 that suspend an external heat belt 164 for heating the surface layer of fixing roller 212*a*.

The components other than these were set in the same manner as in example 1, and a lenticular lens was formed on the PET sheet surface while the toner image was fixed on the opposite side.

As a result, an A4 size lenticular image having lens elements of about 30 μm high, arranged over the whole surface with a pitch of 250 μm was readily formed.

According to the present embodiment having the above configuration, fixing unit 12 of image forming apparatus 100 is configured by forming a plurality of grooves 12*b*1 each having a concavely curved section and extending along the rotational axis, on the surface of pressing roller 12*b*, providing resin layer forming device 120 and layer thickness regulating device 130 in close proximity to pressing roller 12*b* so as to apply a light-transmissive resin material from resin layer forming device 120 over the surface of pressing roller 12*b* to form a transparent resin layer while the layer thickness of the transparent resin layer is adjusted by layer thickness regulating device 130. Accordingly, a lenticular lens structure is formed on the side of recording medium 82 opposite to that formed with unfixed toner image 81 by transferring the transparent resin layer from pressing roller 12*b* and fixing the resin layer on the recording medium while fixing unfixed toner image 81 onto the surface of recording medium 82. As a result, it is possible to provide a space-saving fixing device that will not make equipment bulky and can readily form a lenticular image without causing any degradation of toner image quality.

Further, according to the present embodiment, controller 140 for controlling the operation of fixing unit 12 includes ejection control function 141 for controlling the amount of ejection of light-transmissive resin material from resin layer forming device 120 in accordance with the thickness of a recording medium thickness, gap control function for controlling the movement of presser 132 in accordance with the thickness of the recording medium to control the gap between pressing roller 12*b* and layer thickness regulator 131 and fixing nip temperature control function 143 for controlling the temperature at fixing nip portion 12*c* in accordance with the thickness of the recording medium. Accordingly, it is possible to form a lenticular lens 110 having an optimal thickness in accordance with the thickness of recording medium 82.

Though the above embodiment was described taking examples in which the image forming apparatus of the present invention is applied to image forming apparatus 100 shown in FIG. 1, as long as it is an image forming apparatus that includes a fixing device, the invention can be developed to any other image forming apparatus and the like, not limited to the image forming apparatus and copier having the configuration described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. A fixing device for forming a lenticular lens structure when using a light-transmissive recording medium, comprising:

a fixing member for fusing an unfixed toner image on the recording medium and fixing the unfixed toner image onto the recording medium;

a pressing member for conveying the recording medium while pressing the recording medium against the fixing member;

a resin layer forming portion disposed in close proximity to the pressing member for forming a transparent resin layer by ejecting and applying a light-transmissive resin material on the surface of the pressing member; and a controller for controlling the operation of the resin layer forming portion, wherein the fixing member and the pressing member being put in pressure contact with each other to form a fixing nip portion so that while the recording medium is conveyed through the fixing nip portion by rotation of the fixing member and the pressing member, the unfixed toner image is fixed to the recording medium, wherein a plurality of grooves each having a concavely curved section and extending in the circumferential direction or in the rotational axial direction are formed in parallel to each other on the surface of the pressing member so as to create a lenticular lens structure on the pressing member side of a transparent resin layer formed by the resin layer forming portion, and, wherein, pressing the recording medium on one side of which an unfixed toner image is formed at the fixing nip portion between the fixing member and the pressing member, while transferring the transparent resin layer from the pressing member to the other side of the recording medium, the unfixed toner image is fixed on the one side of the recording medium while a lenticular lens is formed on the other side of the recording medium.

2. The fixing device according to claim 1, wherein the pressing member is formed of a roller member having a metal core portion and a release layer disposed around the metal core portion, or an endless belt member, and the fixing member is formed of a roller member or an endless belt member.

3. The fixing device according to claim 1, wherein the light-transmissive resin material is solid at normal temperature, and the resin layer forming portion forms the transparent resin layer by a hot melt inkjet system including the steps of heating and fusing the light-transmissive resin material and ejecting the molten light-transmissive resin material toward the surface of the pressing member to form a light-transmissive resin layer on the surface of the pressing member.

4. The fixing device according to claim 3, wherein the light-transmissive resin material ejected from the hot melt inkjet system is comprised of a light-transmissive resin and a wax having a phase change temperature of 60 deg.C or higher.

5. The fixing device according to claim 1, further comprising a layer thickness regulating member disposed at a position in close proximity to the outer periphery of the pressing member, upstream of the fixing nip portion and downstream of the resin layer forming portion with respect to the recording medium conveying direction, for regulating the thickness of the light-transmissive resin layer, wherein the controller includes a function of controlling the amount of ejection of the light-transmissive resin material from the resin layer forming portion in accordance with the thickness of the recording medium, a function of controlling the gap between the pressing roller and the layer thickness regulating member in accordance with the thickness of the recording medium and a function of controlling the temperature at the fixing nip portion in accordance with the thickness of the recording medium.

6. The fixing device according to claim 1, wherein the pressing member has a heat source therein and fuses the light-transmissive resin material ejected and applied on the surface thereof.

7. The fixing device according to claim 1, further comprising a contact/retract unit for bringing the pressing member into and out of contact with the fixing member, wherein the contact/retract unit separates the pressing member from the fixing member after completion of the fixing process by the pressing member and the fixing member.

8. An image forming apparatus comprising: an image bearer for forming an electrostatic latent image on the surface thereof; a charger for charging the image bearer surface; an exposure device for forming an electrostatic latent image on the image bearer surface; a developing device for supplying toner to the electrostatic latent image on the image bearer surface to form a toner image; a transfer device for transferring the toner image from the image bearer surface to a recording medium; and a fixing device for fixing the transferred toner image to the recording medium, characterized in that the fixing device employs the fixing device defined in claim 1.

* * * * *